US010661266B2

(12) United States Patent
Kang et al.

(10) Patent No.: US 10,661,266 B2
(45) Date of Patent: May 26, 2020

(54) PIPETTE DEVICE

(71) Applicant: 3M INNOVATIVE PROPERTIES COMPANY, Saint Paul, MN (US)

(72) Inventors: Seong Il Kang, Seoul (KR); Seung Youb Oh, Gyeonggi-Do (KR); In-Hwan Lee, Gyeonggi-Do (KR)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 239 days.

(21) Appl. No.: 15/300,731

(22) PCT Filed: Mar. 31, 2015

(86) PCT No.: PCT/US2015/023608
§ 371 (c)(1),
(2) Date: Sep. 29, 2016

(87) PCT Pub. No.: WO2015/153623
PCT Pub. Date: Oct. 8, 2015

(65) Prior Publication Data

US 2017/0021347 A1 Jan. 26, 2017

(30) Foreign Application Priority Data

Apr. 4, 2014 (KR) ..... 10-2014-0040365

(51) Int. Cl.
*B01L 3/02* (2006.01)
*B01L 3/00* (2006.01)

(52) U.S. Cl.
CPC ..... *B01L 3/021* (2013.01); *B01L 3/0272* (2013.01); *B01L 3/0282* (2013.01);
(Continued)

(58) Field of Classification Search
CPC ..... B01L 3/021; B01L 3/0282; B01L 3/5029; B01L 3/0272; B01L 2300/12;
(Continued)

(56) References Cited

U.S. PATENT DOCUMENTS 4,054,062 A 10/1977 Branham
4,442,722 A 4/1984 Meyer
(Continued)

FOREIGN PATENT DOCUMENTS

CN 203379907 1/2014
GB 804936 11/1958
(Continued)

OTHER PUBLICATIONS

International Search Report for PCT International Application No. PCT/US2015/023608 dated Jun. 29, 2015, 4 pages.
(Continued)

*Primary Examiner* — Sally A Merkling
(74) *Attorney, Agent, or Firm* — Eric E. Silverman

(57) ABSTRACT

A pipette device, including a container having a predetermined space therein, in one end of which a nozzle is formed and the other end of which is opened; a first fixing member whose one end is detachably coupled to the other end of the container; a second fixing member coupled to the other end of the first fixing member; and a pumping member that is inserted into the second fixing member such that an opened end portion faces the other end of the container and delivers internal air into the container by changing shape when it is pressed, wherein the opened end portion of the pumping member is fixed between the first fixing member and the second fixing member by coupling of the first fixing member and the second fixing member.

20 Claims, 11 Drawing Sheets

(52) U.S. Cl.
CPC ..... *B01L 3/5029* (2013.01); *B01L 2200/025* (2013.01); *B01L 2200/06* (2013.01); *B01L 2200/141* (2013.01); *B01L 2300/042* (2013.01); *B01L 2300/043* (2013.01); *B01L 2300/047* (2013.01); *B01L 2300/0832* (2013.01); *B01L 2300/0848* (2013.01); *B01L 2300/12* (2013.01); *B01L 2300/123* (2013.01); *B01L 2300/161* (2013.01); *B01L 2400/0457* (2013.01); *B01L 2400/0481* (2013.01); *B01L 2400/0487* (2013.01)

(58) Field of Classification Search
CPC ..... B01L 2300/042; B01L 2300/0832; B01L 2300/0848; B01L 2200/025; B01L 2200/06; B01L 2300/161; B01L 2300/123; B01L 2300/047; B01L 2300/043; B01L 2200/141; B01L 2400/0481; B01L 2400/0487; B01L 2400/0457
See application file for complete search history.

(56) References Cited

U.S. PATENT DOCUMENTS

| | | | | |
|---|---|---|---|---|
| 5,226,572 | A | 7/1993 | Gargione | |
| 5,238,649 | A | 8/1993 | Nason | |
| 5,477,863 | A | 12/1995 | Grant | |
| 7,300,632 | B2 | 11/2007 | Sugiyama | |
| 8,336,403 | B2 | 12/2012 | Tajima | |
| 2004/0226389 | A1 | 11/2004 | Thom | |
| 2006/0219736 | A1 | 10/2006 | Revenu | |
| 2009/0012425 | A1* | 1/2009 | Dodge | A61B 10/0045 600/572 |
| 2010/0261157 | A1* | 10/2010 | Brock | B01L 3/5029 435/5 |
| 2011/0207621 | A1* | 8/2011 | Montagu | B01L 3/502784 506/9 |
| 2012/0046883 | A1 | 2/2012 | Ayliffe | |
| 2014/0020789 | A1 | 1/2014 | Duquet | |

FOREIGN PATENT DOCUMENTS

| | | |
|---|---|---|
| GB | 854406 | 11/1960 |
| JP | 59-093744 | 6/1984 |
| JP | 2006-329728 | 12/2006 |
| KR | 10-0477918 | 3/2005 |
| KR | 30-0488926 | 4/2008 |
| KR | 2012-0002135 | 3/2012 |
| KR | 10-2013-0101176 | 9/2013 |
| RU | 86788 | 10/2013 |
| WO | WO 03/026512 | 4/2003 |
| WO | WO 2007/016618 | 2/2007 |
| WO | WO 2008/060171 | 5/2008 |
| WO | WO 2012/027447 | 3/2012 |

OTHER PUBLICATIONS

Supplementary European Search Report for 15 77 2737 dated Jul. 28, 2017.

* cited by examiner

PIPETTE DEVICE

CROSS REFERENCE TO RELATED APPLICATIONS

This application is a national stage filing under 35 U.S.C. 371 of PCT/US2015/023608, filed Mar. 31, 2015, which claims the benefit of Korean Application No. 10-2014-0040365, filed Apr. 4, 2014, the disclosures of which are incorporated by reference in their entirety herein.

TECHNICAL FIELD

The present invention relates to a pipette device.

BACKGROUND

In order to collect a sample such as microorganisms, a sampler including a collecting member made of cotton and the like may be used. When a sample is collected from a specific surface using the above collecting member and is input to a sampler chamber, the sample collected by the collecting member may be mixed with a diluted solution stored in the sampler chamber. In order to use the sample collected in the sampler chamber, the diluted solution mixed with the sample should be discharged to the outside of the sampler chamber. In order to accurately know a dilution ratio of the sample, or in order to use an accurate amount of sample, it is important to know accurately an amount of a liquid discharged from the sampler chamber.

In order to discharge an accurate amount of liquid, a micropipette and the like may be used. In addition, as disclosed in U.S. Pat. No. 7,300,632, a sampler may have a scale displayed in a chamber thereof, and may be deformable so that the sampler itself may be used as a pipette (see U.S. Pat. No. 7,300,632 (Date of Grant: Nov. 27, 2007)).

However, the above technique has the following problems.

Micropipettes in the related art need to be provided separately from a sampler, and are inconvenient to prepare, use, and maintain. In addition, when a user views a scale displayed in a sampler chamber and discharges a liquid, a relative height of a scale and a liquid may be changed according to a position from which a user views the scale. In addition, the user should adjust an amount of a liquid to be discharged by adjusting a degree of pressing the sampler chamber while viewing the scale. As a result, according to these operations, there is a problem in which an amount of a liquid discharged from the sampler is inaccurate.

SUMMARY

According to an aspect of the present invention, there is provided a pipette device, including a container having a predetermined space therein, of which a nozzle is formed at one end thereof and the other end is opened; a first fixing member whose one end is detachably coupled to the other end of the container; a second fixing member coupled to the other end of the first fixing member; and a pumping member that is inserted into the second fixing member such that an opened end portion faces the other end of the container, delivers interior air into the container by changing in shape when it is pressed, and presses an internal space of the container, wherein the opened end portion of the pumping member is fixed between the first fixing member and the second fixing member by coupling the first fixing member to the second fixing member.

Embodiments of the present invention may provide a pipette device capable of discharging an accurate amount of liquid with simple manipulation.

BRIEF DESCRIPTION OF EXAMPLATORY EMBODIMENTS

Hereinafter, detailed embodiments for implementing the scope and sprit of the present invention will be described in detail with reference to the accompanying drawings. For the convenience of description, it should be understood that drawings are not to scale.

Figure 1:
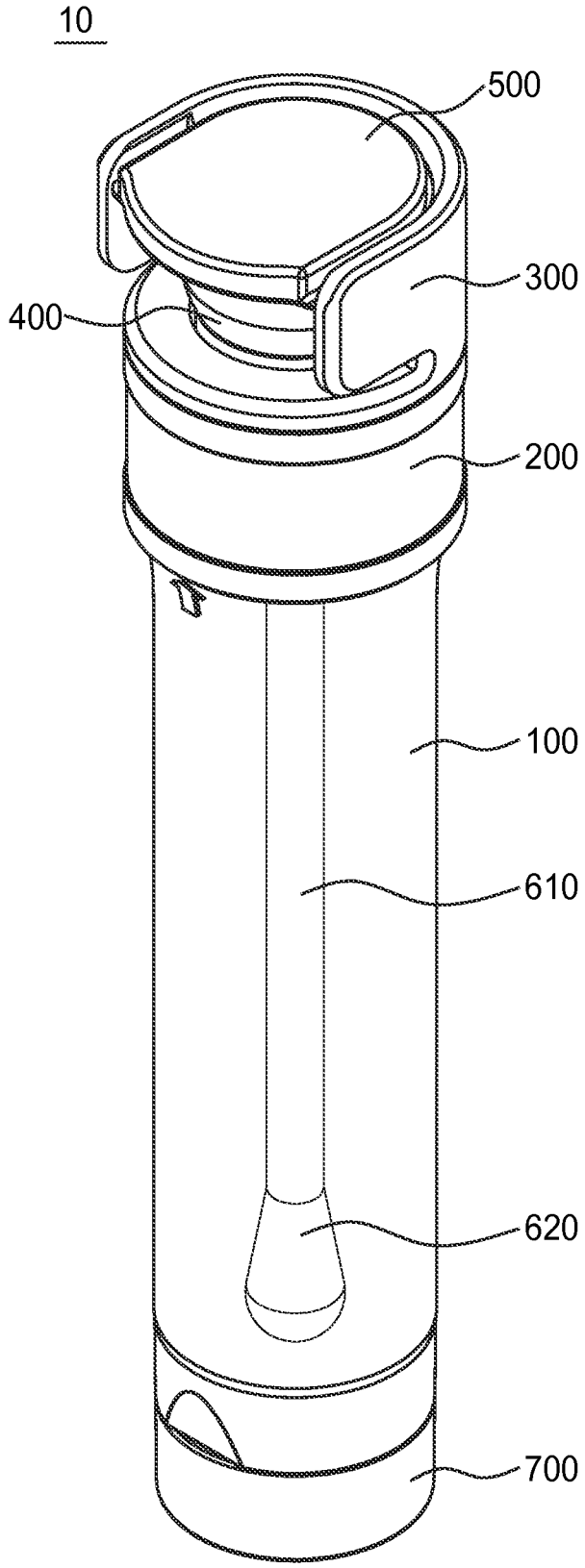
FIG. 1 is a perspective view illustrating a pipette device according to an embodiment of the present invention.
Figure 2:
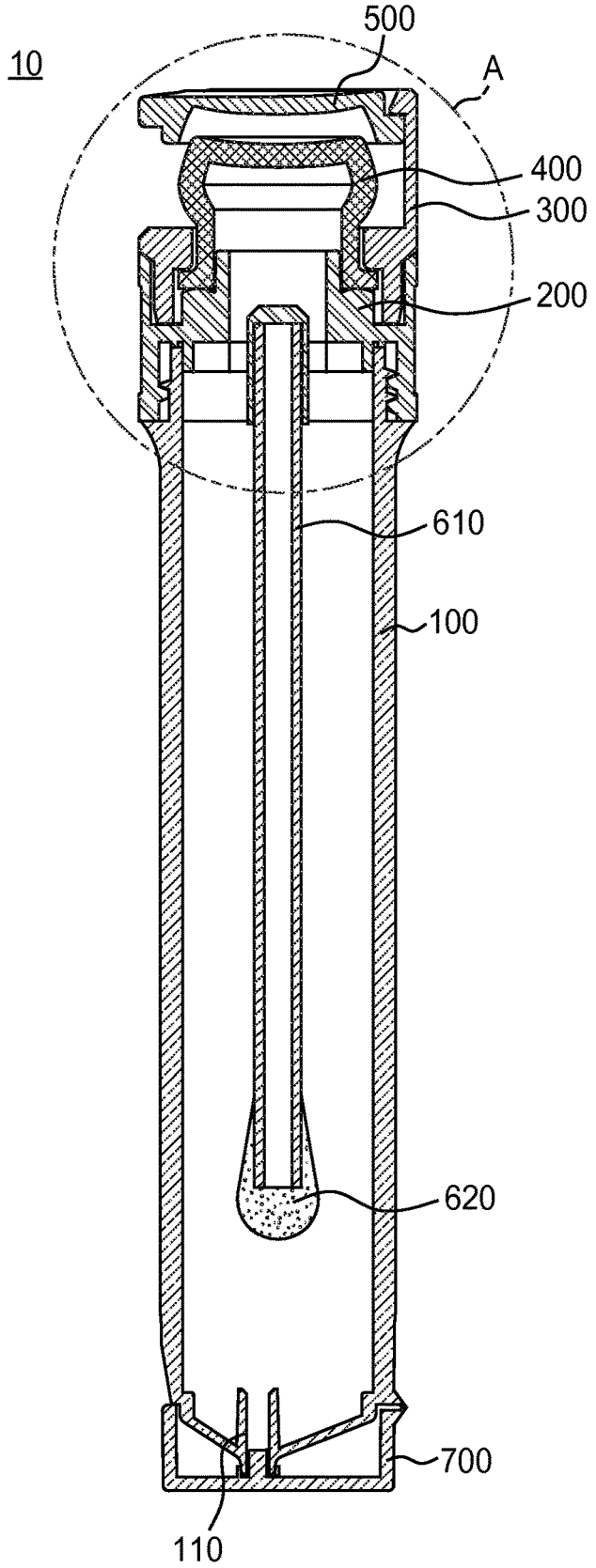
FIG. 2 is a side cross-sectional view illustrating the pipette device in FIG. 1.
Figure 3:
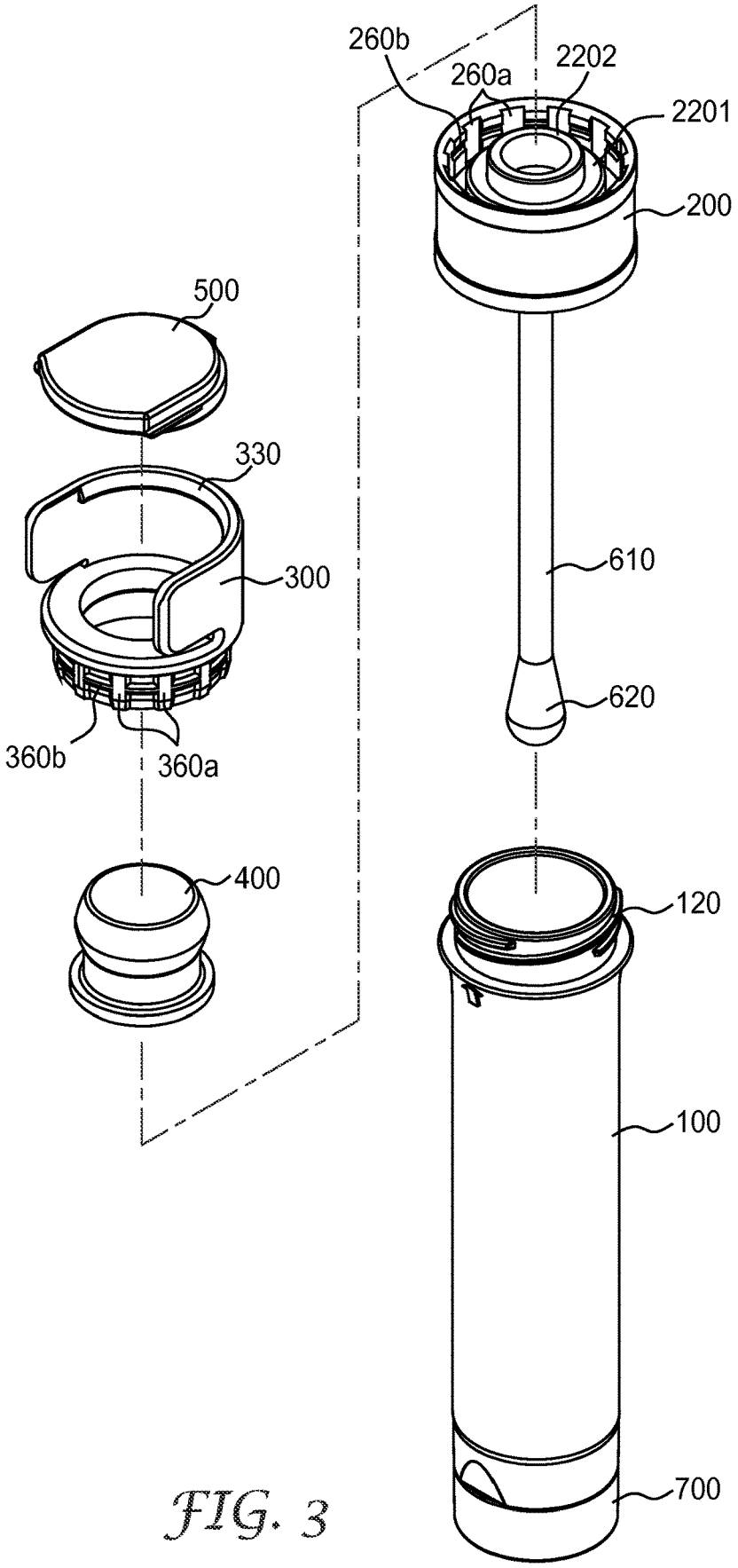
FIG. 3 is an exploded perspective view illustrating components included in the pipette device in FIG. 1.
Figure 4:
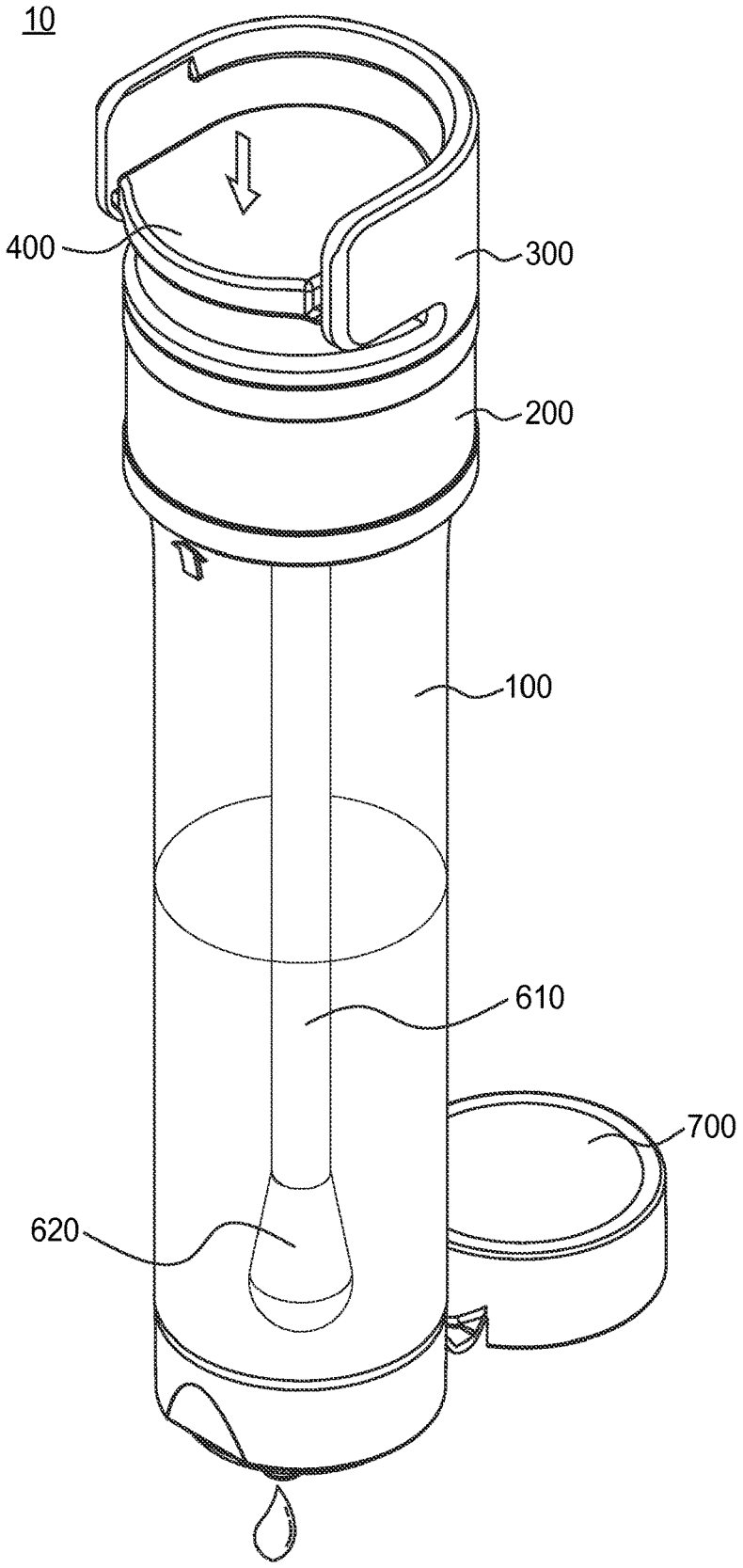
FIG. 4 is a perspective view illustrating an operation of the pipette device in FIG. 1.

FIG. 1 is a perspective view illustrating a pipette device 10 according to an embodiment of the present invention. FIG. 2 is a side cross-sectional view illustrating the pipette device 10 in FIG. 1. In addition, FIG. 3 is an exploded perspective view illustrating components included in the pipette device 10 in FIG. 1. FIG. 4 is a perspective view illustrating an operation of the pipette device 10 in FIG. 1.

Referring to FIGS. 1 to 4, the pipette device 10 according to the embodiment of the present invention may include a container 100 having a predetermined space therein, of which a nozzle 110 is formed at one end thereof, and the other end is opened, a first fixing member 200 whose one end is detachably coupled to the other end of the container 100, a second fixing member 300 coupled to the other end of the first fixing member 200, and a pumping member 400 that is inserted into the second fixing member 300 such that an opened end portion faces the other end of the container 100, delivers interior air into the container 100 by changing in shape when it is pressed, and pressurizes an internal space of the container 100. The opened end portion of the pumping member 400 may be fixed between the first fixing member 200 and the second fixing member 300 when the first fixing member 200 and the second fixing member 300 are coupled.

The container 100 may be a cylindrical member having an empty space therein. The container 100 may be made of a plastic, and may be transparently or semi-transparently formed. A liquid may be stored in the internal space of the container 100, and the stored liquid may have a preset volume. The liquid stored in the container 100 may be a diluted solution.

The nozzle 110 may be formed in one end of the container 100, and the other end provided opposite thereto may be an opened end portion. Through the opened end portion, a liquid such as a diluted solution may be introduced into the internal space of the container 100. Through the nozzle 110, the liquid stored in the container 100 may be discharged to the outside. The liquid stored in the container 100 may be discharged to the outside through the nozzle 110 when the internal space of the container 100 is pressed. In the present embodiment, when the pumping member 400 is pressed and a shape thereof changes, the internal space of the container 100 may be pressed according to delivery of the interior air into the container 100. When the internal space of the container 100 is pressed, the liquid inside the container 100 may be discharged through the nozzle 110.

In the opened end portion in the opposite side of the container 100, a thread 120 (see FIG. 5) may be formed along an outer circumferential surface. As will be described below, the thread 120 may be used to couple the container 100 and the first fixing member 200.

The first fixing member 200 may be detachably coupled to the opened end portion of the container 100. For this purpose, a thread 290 may be formed in an inside surface of the first fixing member 200. In this case, the first fixing member 200 may be coupled to the opened end portion of the container 100 by a thread. A user may rotate the first fixing member 200 in one direction to couple the first fixing member 200 and the container 100, and rotate the first fixing member 200 in a reverse direction to separate the first fixing member 200 from the container 100.

The first fixing member 200 may be a cylindrical member that includes a partition wall 220 dividing an inside into an upper portion and a lower portion and at least one fluid passage that is formed by passing through the partition wall 220. With respect to the partition wall 220, the upper portion may be coupled to the second fixing member 300, and the lower portion may be coupled to the container 100. When the first fixing member 200 and the second fixing member 300 are coupled by interposing the pumping member 400 therebetween, the partition wall 220 may support a lower end of the pumping member 400 and fix a position thereof. The fluid passage may provide a path along which a fluid flows between the container 100 and the pumping member 400. For this purpose, one side of the fluid passage may communicate with the internal space of the container 100, and the other side thereof may communicate with an internal space of the pumping member 400. When the pumping member 400 is pressed, air therein may be delivered into the container 100 through the fluid passage.

A collecting tip 620 is formed at an end portion of the first fixing member 200. When the first fixing member 200 is coupled to the container 100, a stick member 610 accommodated inside the container 100 may be fixed.

The stick member 610 may be a bar-shaped member made of a polymer resin. The stick member 610 may be inserted into, and fixed to a stick fixing portion 250 of the first fixing member 200. As an example, while the stick member 610 is inserted into the stick fixing portion 250, an adhesive is applied between the stick member 610 and the stick fixing portion 250, and the stick member 610 may be adhered to the stick fixing portion 250. In addition, while the stick member 610 is inserted into the stick fixing portion 250, when at least one of the stick member 610 and the stick fixing portion 250 is heated, or heat treatment is performed thereon, the stick member 610 may be adhered to the stick fixing portion 250.

The collecting tip 620 may be formed at an end portion of the stick member 610. The collecting tip 620 may be made of a polyurethane, but a material of the collecting tip 620 is not limited thereto. The collecting tip 620 may also be made of another material such as cotton coated with a polymer resin.

The second fixing member 300 may be a cylindrical member having a through-hole 310 (see FIG. 7A) formed therein and a predetermined length, and may be coupled to the first fixing member 200 at an end portion opposite to an end portion in which the first fixing member 200 is coupled to the container 100. A part of a side surface of the second fixing member 300 may be formed at an opened shape. The pumping member 400 may be inserted into the through-hole 310 of the second fixing member 300.

The pumping member 400 may be an elastic member that has an opened end portion in one side and an empty space capable of accommodating air therein. An elastic material of the pumping member 400 may be silicone or rubber, but the material is not limited thereto. According to elasticity of the pumping member 400, the pumping member 400 has a shape that changes when pressed, and that may be restored when the pressing operation is completed.

The pumping member 400 may be inserted into the second fixing member 300 such that the opened end portion thereof faces the opened end portion of the container 100. While the pumping member 400 is inserted into the second fixing member 300, the second fixing member 300 may be coupled to the first fixing member 200. In this case, the opened end portion of the pumping member 400 is positioned between the first fixing member 200 and the second fixing member 300, and may be fixed between the first fixing member 200 and the second fixing member 300 when the first fixing member 200 and the second fixing member 300 are coupled.

When the opened end portion of the pumping member 400 is disposed to face the opened end portion of the container 100, the internal space of the pumping member 400 and the internal space of the container 100 may communicate with each other. When the pumping member 400 is pressed, a shape thereof changes, and interior air is pushed. In this case, the pushed air may be introduced into the internal space of the container 100. An inside of the container 100 may be pressed by air introduced into the container 100 from the pumping member 400. As the inside of the container 100 is pressed, the liquid stored inside the container 100 may be discharged through the nozzle 110.

In addition, since the opened end portion of the pumping member 400 is fixed between the first fixing member 200 and the second fixing member 300, a position of the pumping member 400 serving as a pressing portion may be firmly fixed in the pipette device 10. Since the position of the pumping member 400 is fixed in the pipette device 10, even when the pumping member 400 is pressed, the position of the pumping member 400 is not changed, and only a shape thereof may change. In addition, when the pumping member 400 is pressed, since a lower end portion of the pumping member 400 is not pushed downward, a degree of a change in the shape of the pumping member 400, when the pumping member 400 is pressed once, may be maintained at a constant level. As a result, when the pumping member 400 is pressed once, a volume of air delivered from the pumping member 400 into the container 100 may be maintained at a constant level.

When a volume of air introduced into the container 100 is maintained at a constant level if the pumping member 400 is pressed once, a pressure at a constant level may be applied into the container 100 whenever the pumping member 400 is pressed. When a liquid is stored inside the container 100, if the inside of the container 100 is pressed, a volume of a liquid discharged through the nozzle 110 is proportional to the level of the pressure applied into the container 100. In the present embodiment, whenever the pumping member 400 is pressed, since a pressure at a constant level is applied into the container 100, a liquid of a constant volume may be discharged to the outside of the container 100 through the nozzle 110 whenever the pumping member 400 is pressed. Therefore, without a separate scale, the user may discharge a liquid of a constant volume from the pipette device 10 by only pressing the pumping member 400.

In this case, when the pumping member 400 is pressed once, a volume of a liquid discharged through the nozzle 110 may have a preset value. The preset value may be, for example, 1 mL. In this case, the pumping member 400 may be designed to have a size and a shape such that a liquid of the predetermined volume may be discharged when the pumping member 400 is pressed.

In addition, when the pumping member 400 is firmly fixed in the pipette device 10, the position of the pumping member 400 may be maintained without change even if the pressure of outside air decreases. As a result, it is possible to prevent a gap between the pumping member 400 and the container 100 from occurring in a reduced pressure environment, and it is possible to prevent the liquid inside the container 100 from leaking through the gap. This effect is particularly useful when the pipette device 10 is transported by airplane. When the pipette device 10 of the present embodiment is transported by airplane, there is no leakage. As a result, it can be easily exported to other countries.

Referring again to FIGS. 1 to 4, the pipette device 10 may further include a pressing plate 500 that is inserted between the second fixing member 300 and the pumping member 400, and is mounted on an upper surface of the pumping member 400. The pressing plate 500 may be a flat plate member having a shape corresponding to a cross section of the second fixing member 300. Since the pressing plate 500 is provided on the upper surface of the pumping member 400, the user may press the pumping member 400 by pressing the pressing plate 500.

The pumping member 400 is made of an elastic material. If there is a portion on which a pressure is particularly concentrated when the pumping member 400 is pressed, further deformation occurs in that portion. If the portion on which a pressure is concentrated is changed whenever the pumping member 400 is pressed, a shape into which the pumping member 400 changes may be different every time. In this case, as a result, an amount of a liquid discharged from the nozzle 110 may change every time. When the pumping member 400 is pressed, the pressing plate 500 may uniformly deliver a pressure to the upper surface of the pumping member 400. As a result, whenever the pumping member 400 is pressed, a shape into which the pumping member 400 changes may remain the same. As a result, whenever the pumping member 400 is pressed, an amount of a liquid discharged from the nozzle 110 may be further constantly maintained without error.

Figure 5:
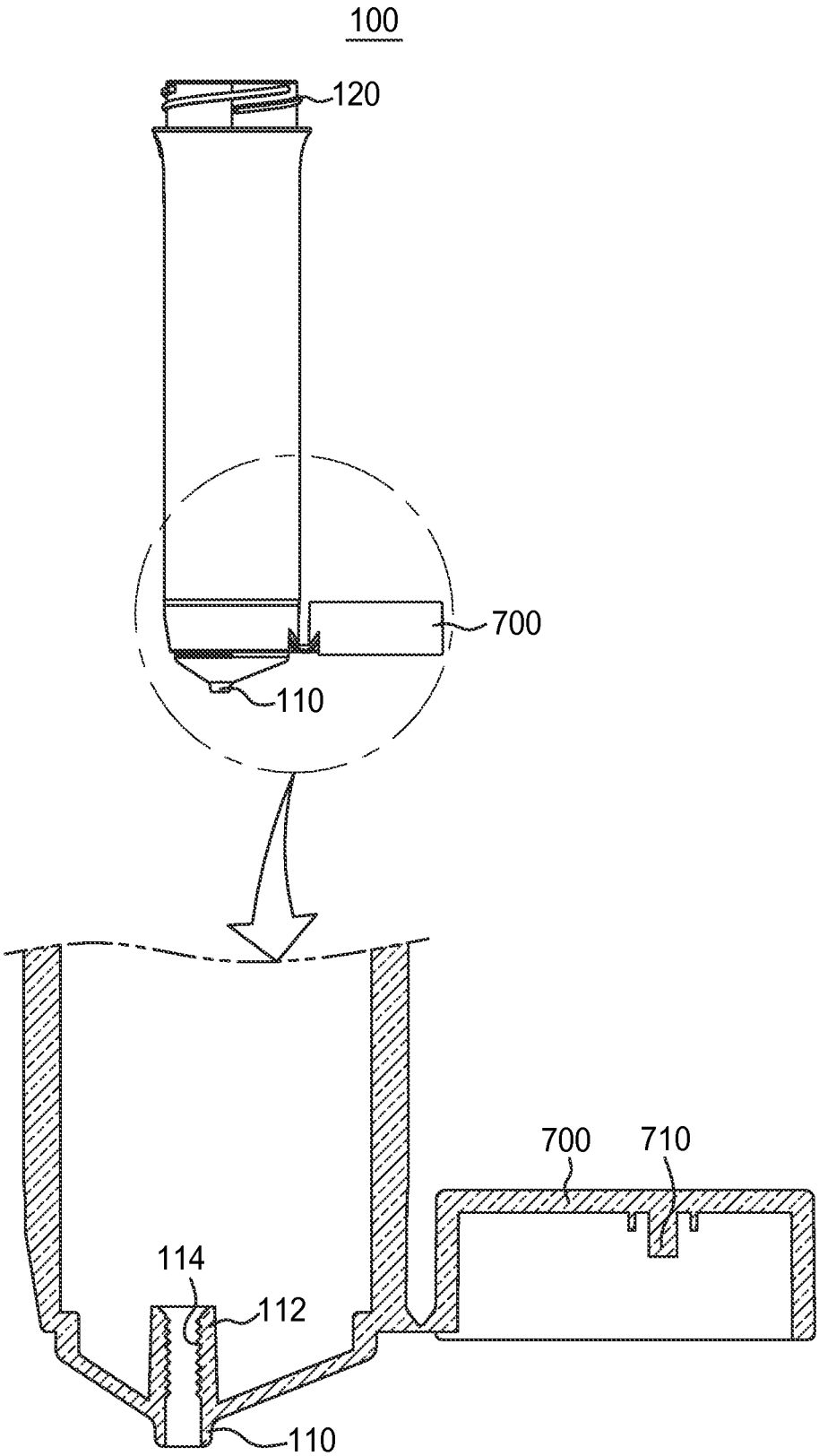
FIG. 5 shows a side view and a partially enlarged view of a container in FIG. 3.

FIG. 5 shows a side view illustrating the container 100 in FIG. 3 and a partially enlarged view illustrating an enlarged lower portion of the container 100.

Referring to FIG. 5, the pipette device 10 may further include a cap 700 capable of opening and closing the nozzle 110. The cap 700 may be connected to an end portion in which the nozzle 110 of the container 100 is formed. When a part of the cap 700 is integrally formed with one end of the container 100, the cap 700 may be connected to one end of the container 100. In one end of the container 100, a step portion may be formed along a circumference thereof. When the cap 700 is inserted into the step portion, the nozzle 110 may be closed. A portion connecting the cap 700 and the container 100 may be bent. When the cap 700 is separated from one end of the container 100, the connecting portion may be bent to open the nozzle 110.

The cap 700 may include an insertion protrusion 710 that protrudes from an inside surface. When the cap 700 is inserted into the step portion, the insertion protrusion 710 may be inserted into the nozzle 110. According to the insertion of the insertion protrusion 710 into the nozzle 110, the nozzle 110 may be firmly closed when the cap 700 is coupled.

According to the embodiment, an extending portion 112 that extends upwardly from an upper end of the nozzle 110 of the container 100 may be formed inside the container 100. The extending portion 112 may have a shape in which the nozzle 110 extends to the container 100 having a predetermined length. That is, the extending portion 112 may be formed in a cylindrical shape in which a hole is formed at the center. The hole may communicate with the nozzle 110. A diameter of the hole may be the same as an inner diameter of the nozzle 110.

When the extending portion 112 that extends from the upper end of the nozzle 110 is formed inside the container 100, the liquid stored inside the container 100 should pass through an upper end of the extending portion 112 to be introduced into the nozzle 110. However, when the extending portion 112 having a circular cross section protrudes from a lower end surface of the container 100, only an area corresponding to a circular upper end surface of the extending portion 112 comes in contact with the liquid at an upper portion of the nozzle 110. In addition, there is air inside the hole of the extending portion 112. As a result, an attractive force between the liquid and a surface of the container 100 decreases at the upper portion of the nozzle 110. Accordingly, a phenomenon in which the liquid is introduced into the nozzle 110 when the inside of the container 100 is not pressed, may be minimized. That is, by forming the extending portion 112, even when a pressure is not applied into the container 100, it is possible to prevent the liquid stored in the container 100 from leaking through the nozzle 110.

According to another embodiment, an inner circumferential surface of the extending portion 112 may include a plurality of uneven portions 114. Here, when the plurality of uneven portions 114 are formed, the inner circumferential surface of the extending portion 112 may have a predetermined surface roughness. The surface roughness may have a predetermined value. The predetermined surface roughness value may be a value at which hydrophobicity of the inner circumferential surface of the extending portion 112 increases. The predetermined surface roughness value may be changed by a material forming the extending portion 112 or a type of a liquid to be stored inside the container 100. The predetermined surface roughness value may be determined by an experiment. The plurality of uneven portions 114 may have a uniform shape or a constant size, but the present invention is not limited thereto.

As an example, the extending portion 112 may be formed at the same time when the nozzle 110 is formed. In this case, in order to form the uneven portion 114 in the inner circumferential surface of the extending portion 112, a mold in which an uneven portion is formed in a surface may be used when the extending portion 112 is formed. The mold may have a predetermined surface roughness, due to the uneven portion formed in the surface of the mold. In this case, the extending portion 112 may be formed to have an inner circumferential surface that has the same surface roughness as the mold or a similar surface roughness to the mold.

When a plurality of uneven portions 114 are formed on the inner circumferential surface of the extending portion 112, the extending portion 112 may be modified to have a hydrophobic inner surface. When the extending portion 112 has the hydrophobic inner surface, an attractive force acting between an inside of the extending portion 112 and the liquid stored in the container 100 may be further decreased. As a result, it is possible to prevent the liquid stored in the container 100 from leaking through the nozzle 110 when no pressure is applied into the container 100.

Figure 6A:
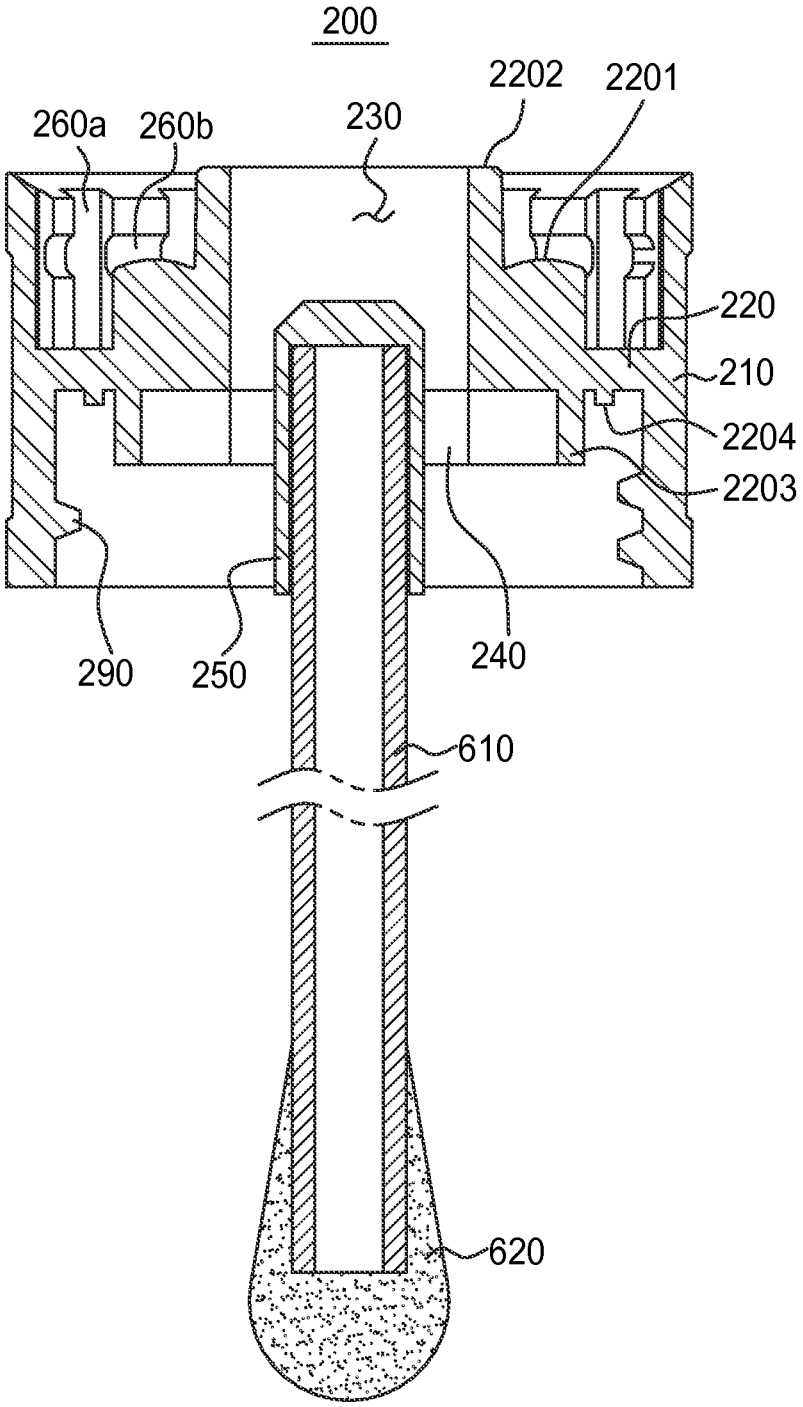
FIGS. 6A and 6B are a side cross-sectional view and a plan view of a first fixing member in FIG. 3, respectively.
Figure 6B:
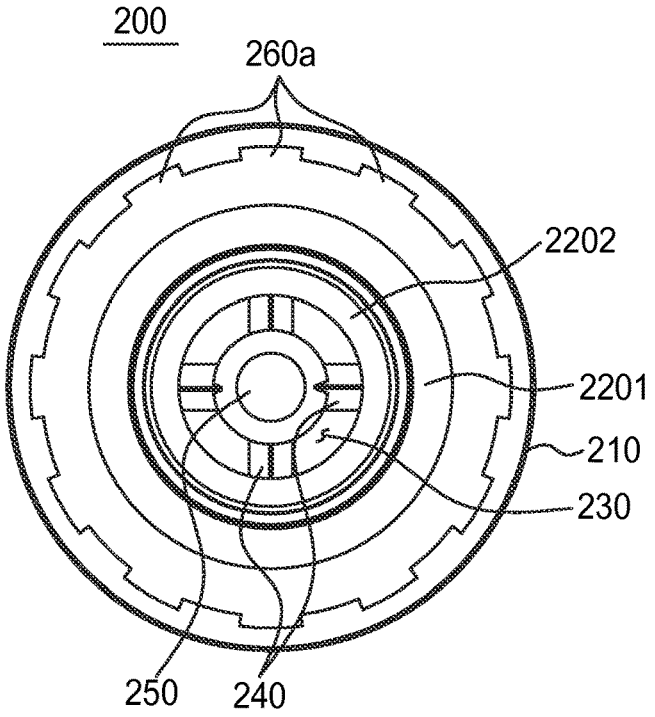

FIG. 6A is a side cross-sectional view illustrating the first fixing member 200 in FIG. 3. FIG. 6B is a plan view of the first fixing member 200 when viewed from the top.

Referring to FIGS. 6A and 6B, together with FIG. 3, the first fixing member 200 may include a cylindrical body 210, the partition wall 220 that protrudes inward from an inner circumferential surface of the body 210 and divides an inside of the body 210 into an upper portion and a lower portion, and a communication hole 230 that passes through the partition wall 220.

In an upper surface of the partition wall 220, a first support 2201 that protrudes upwardly along a circumference of the communication hole 230 and a second support 2202 that has an outer diameter, which is smaller than that of the first support 2201, and protrudes upwardly from an upper surface of the first support 2201 along the circumference of the communication hole 230 may be formed. The outer diameter of the first support 2201 is greater than an inner diameter of the pumping member 400, and an outer diameter of the second support 2202 may be smaller than or the same as the inner diameter of the pumping member 400.

When the first fixing member 200 and the second fixing member 300 are coupled by interposing the pumping member 400 therebetween, the opened end portion of the pumping member 400 may be mounted on the upper surface of the first support 2201. The first support 2201 supports the opened end portion of the pumping member 400 from below. When the pumping member 400 is pressed, the opened end portion of the pumping member 400 is caught by the first support 2201, and downward movement is restricted. As a result, a position of the opened end portion of the pumping member 400 may be fixed between the first fixing member 200 and the second fixing member 300. In addition, the second support 2202 may be inserted into the pumping member 400, and may firmly support a lower portion of the pumping member 400 from thereinside.

According to the embodiment, the upper surface of the first support 2201 may be formed on a curved surface that is convex and faces upwardly. When the pumping member 400 is pressed, the pumping member 400 is vertically compressed, and a lower end portion of the pumping member 400 may be pushed outwardly. In this case, when the upper surface of the first support 2201 is formed on the curved surface that is convex and faces upwardly, it is possible to prevent the lower end portion of the pumping member 400 from being pushed outwardly.

Specifically, when the upper surface of the first support 2201 has a convex curved surface shape, if the pumping member 400 is pressed, the outward movement of the lower end portion of the pumping member 400 may be restricted by bending of the first support 2201. That is, the end portion of the pumping member 400 is caught by bending of the upper surface of the first support 2201, and may not be pushed outwardly.

The communication hole 230 may serve as a fluid passage connecting an inside of the container 100 and an inside of the pumping member 400. Inside the communication hole 230, the stick fixing portion 250 into which the stick member 610 may be inserted and fixed may be provided. The stick fixing portion 250 may be connected to the circumferential surface of the communication hole 230 by a plurality of ribs 240 such that the communication hole 230 may still serve as the fluid passage. When the pumping member 400 is pressed, internal air of the pumping member 400 may be delivered into the container 100 through a space between the ribs 240.

In a lower surface of the partition wall 220, a circular third support 2203 that protrudes downwardly from the outside of the communication hole 230 and a circular fourth support 2204 that protrudes downwardly from the outside of the third support 2203 may be formed. The third support 2203 and the fourth support 2204 may be formed to be spaced from each other. A protrusion height of the fourth support 2204 may be greater than that of the third support 2203. In addition, an outer diameter of the third support 2203 may be smaller than or the same as an inner diameter of the container 100. An inner diameter of the fourth support 2204 may be greater than that of the container 100, and may be smaller than an outer diameter of the container 100.

When the container 100 and the first fixing member 200 are coupled, the third support 2203 of the first fixing member 200 is inserted into the container 100 through the opened end portion of the container 100. In this case, the fourth support 2204 may come in contact with a surface of the end portion of the container 100.

In the first fixing member 200, in an upper portion of the partition wall 220 among the inner circumferential surface of the body 210, a plurality of first fastening grooves 260*a* that extend to a longitudinal direction of the body 210 and are disposed to be spaced from each other and a second fastening groove 260*b* that extends along a circumference of the body 210 may be formed. The second fastening groove 260*b* may be perpendicular to each of the first fastening grooves 260*a*. A first fastening protrusion 360*a* and a second fastening protrusion 360*b* of the second fixing member 300 to be described may be inserted into the first fastening groove 260*a* and the second fastening groove 260*b*, respectively. When the first fastening protrusion 360*a* is inserted into the first fastening groove 260*a* and the second fastening protrusion 360*b* is inserted into the second fastening groove 260*b*, the first fixing member 200 and the second fixing member 300 may be coupled.

Figure 7A:
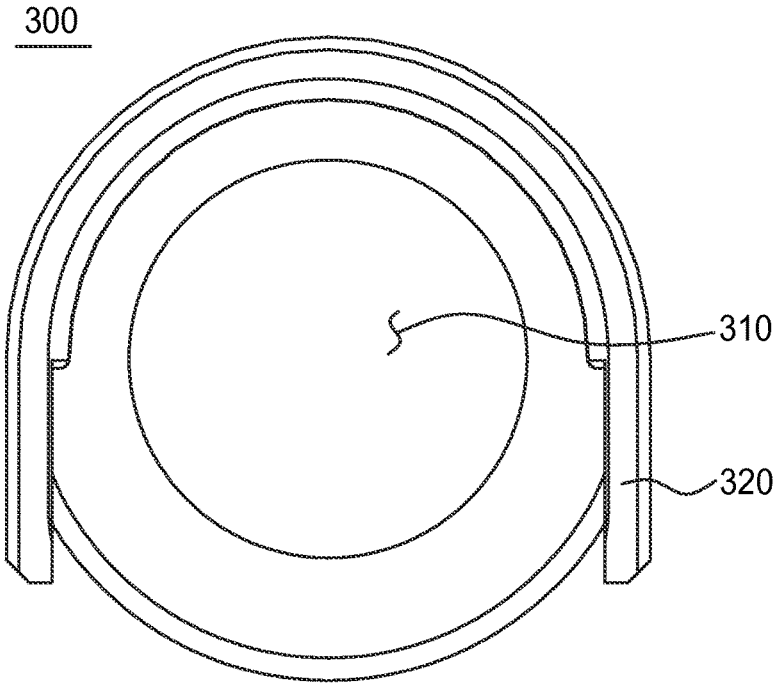
FIGS. 7A and 7B are a plan view illustrating a second fixing member in FIG. 3 and a perspective view illustrating a bottom surface of the second fixing member.
Figure 7B:
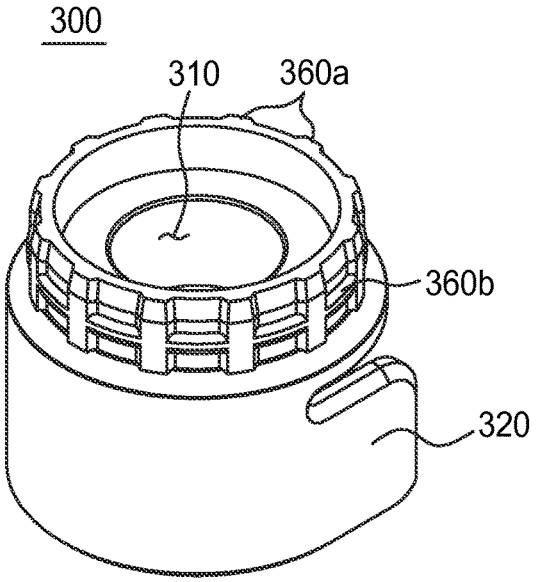

FIG. 7A is a plan view of the second fixing member 300 in FIG. 3 when viewed from the top. FIG. 7B is a perspective view of the second fixing member 300 with a bottom surface facing upwardly.

Referring to FIGS. 7A and 7B, together with FIG. 3, the second fixing member 300 may include a cylindrical body 320 whose side surface is partially recessed from an upper end, the through-hole 310 that is formed by passing through the body 320 and into which the pumping member 400 is inserted, and a protrusion 330 that protrudes inward from an upper end of the inner circumferential surface of the body 320.

The recessed portion of the body 320 may have a width at which the user's thumb can be inserted. The user may push his or her thumb into the second fixing member 300 through the recessed portion and press the pumping member 400. The protrusion 330 may be formed on a side opposite to the recessed portion of the body 320. A fastening protrusion of the pressing plate 500 to be described may be caught in the protrusion 330. While the pressing plate 500 is mounted on the upper surface of the pumping member 400, when the fastening protrusion of the pressing plate 500 is caught in the protrusion 330, the pressing plate 500 may be inserted between the pumping member 400 and the second fixing member 300.

Meanwhile, in the second fixing member 300, in a lower portion of an outer circumferential surface of the body 320, a plurality of first fastening protrusions 360*a* that extend to a longitudinal direction of the body 320 and are disposed to be spaced from each other, and the second fastening protrusion 360*b* that extends along a circumference of the body 320 may be formed. The second fastening protrusion 360*b* may be perpendicular to each of the first fastening protrusions 360*a*. As described above, when the first fastening protrusion 360*a* is inserted into the first fastening groove 260*a* and the second fastening protrusion 360*b* is inserted into the second fastening groove 260*b*, the first fixing member 200 and the second fixing member 300 may be coupled.

Coupling of the first fastening groove 260*a* and the first fastening protrusion 360*a* may restrict rotation of the second fixing member 300. Coupling of the second fastening groove 260*b* and the second fastening protrusion 360*b* may fix a position of the second fixing member 300 in a longitudinal direction.

The plurality of first fastening grooves 260*a* may be disposed to have a constant interval therebetween. In order to correspond thereto, a plurality of first fastening protrusions 360*a* may be disposed to have the same interval therebetween. When a plurality of first fastening grooves 260*a* and the plurality of first fastening protrusions 360*a* are disposed to have the same interval therebetween, the second fixing member 300 may be coupled to the first fixing member 200, regardless of a direction in which the second fixing member 300 faces.

Since a plurality of first fastening grooves 260*a* and a plurality of first fastening protrusions 360*a* are disposed to be spaced from each other, when each of the first fastening protrusions 360*a* can be inserted into each of the first fastening grooves 260*a* if the second fixing member 300 faces in a specific direction, each of the first fastening protrusions 360*a* can be inserted into each of the first fastening grooves 260*a* again only when the second fixing member 300 is rotated by a constant angle from that state. In addition, each of the first fastening protrusions 360*a* can be inserted into each of the first fastening grooves 260*a* only when the second fixing member 300 rotates by the constant angle or additionally rotates a multiple of the constant angle in the same direction again. Therefore, when the user couples the first fixing member 200 and the second fixing member 300, or when the first fixing member 200 and the second fixing member 300 are coupled in a process of manufacturing the pipette device 10, constant angular intervals may be set in a direction in which the recessed portion of the second fixing member 300 faces.

While the present embodiment has exemplified a case in which the first fixing member 200 and the second fixing member 300 are coupled using the pluralities of grooves and protrusions, the scope of the present invention is not limited thereto. Various coupling structures in which the first fixing member 200 and the second fixing member 300 may be coupled by interposing the lower end portion of the pumping member 400 therebetween may be used.

Figure 8:
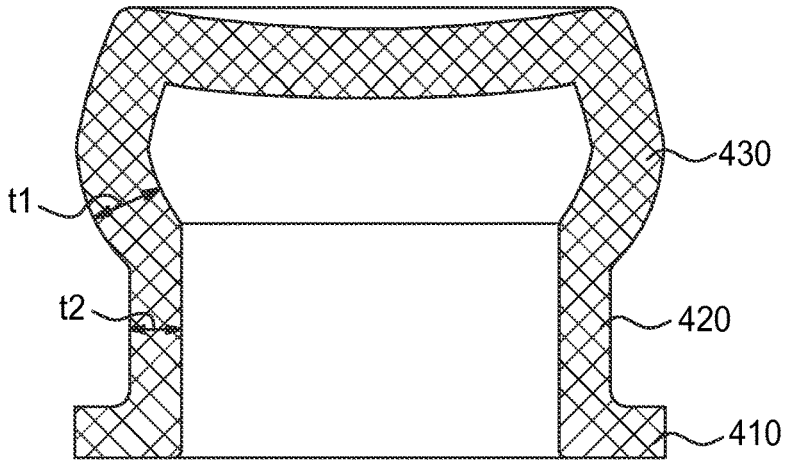
FIG. 8 is a side cross-sectional view illustrating a pumping member in FIG. 3.

FIG. 8 is a side cross-sectional view illustrating the pumping member 400 in FIG. 3.

Referring to FIG. 8, together with FIG. 3, the pumping member 400 may include a pressing portion 430 having an empty space therein, a column portion 420 that extends to a longitudinal direction with a predetermined length from an end portion of the pressing portion 430, and a flange portion 410 that protrudes perpendicular to the column portion 420 from an end portion of the column portion 420 along a circumference of the column portion 420.

The pressing portion 430 may include an upper surface that has a flat pocket shape. When the flat upper surface is pressed by the user, the shape may be changed by compression. In a lower end of the pressing portion 430, a circular opening may be formed. The column portion 420 may extend along a circumference of the circular opening and protrude to a longitudinal direction with a predetermined length. In a lower end of the column portion 420, the flange portion 410 may be formed in an outward direction. When the first fixing member 200 and the second fixing member 300 are coupled, while the column portion 420 is inserted into the second fixing member 300, the flange portion 410 may be inserted between the first fixing member 200 and the second fixing member 300. When the flange portion 410 is inserted between the first fixing member 200 and the second fixing member 300, the position of the pumping member 400 may be fixed.

According to the embodiment of the present invention, a thickness t1 of the pressing portion 430 may be greater than a thickness t2 of the column portion 420. In this case, when the user presses an upper surface of the pressing portion 430, a relatively great change may occur in a portion whose thickness is changed, that is, in a boundary between the pressing portion 430 and the column portion 420. As a result, the boundary between the pressing portion 430 and the column portion 420 may be intensively compressed, and the user may feel a clicking sensation, upon pressing the pressing portion 430. The user presses the pumping member 400 until he or she feels the clicking sensation. When he or she feels the clicking sensation, the pressing operation may be completed. Therefore, usability may be improved.

Figure 9A:
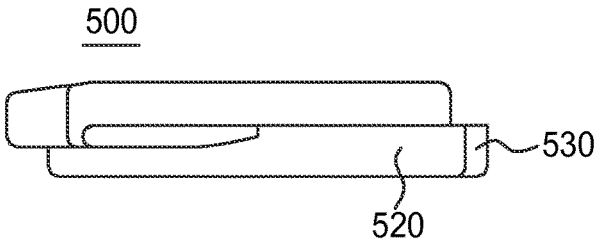
FIGS. 9A and 9B are a side view illustrating a pressing plate in FIG. 3 and a perspective view illustrating a bottom surface of the pressing plate.

FIG. 9A is a side view illustrating the pressing plate 500 in FIG. 3.

Figure 9B:
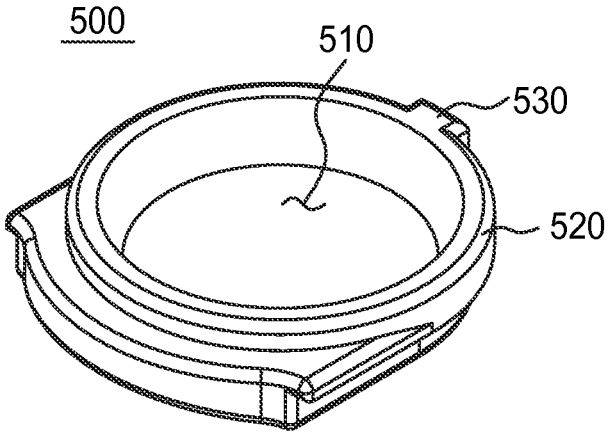

FIG. 9B is a perspective view of the pressing plate 500 with a bottom surface facing upwardly.

Referring to FIGS. 9A and 9B, together with FIG. 3, the pressing plate 500 may include a body 520 having a flat upper surface, a circular groove 510 formed on a lower surface of the body 520, and a fitting protrusion 530 that protrudes outwardly from an outer circumferential surface of the body 520.

The body 520 may have a flat upper surface and a shape corresponding to a cross section of an upper portion of the second fixing member 300. A diameter of the circular groove 510 may be greater than that of the upper surface of the pumping member 400. In the circular groove 510, while the pumping member 400 is inserted, the pressing plate 500 may be mounted on the upper surface of the pumping member 400. When the pressing plate 500 is mounted, the fitting protrusion 530 may be positioned below the protrusion 330 of the second fixing member 300. When the fitting protrusion 530 is caught by the protrusion 330, the upward movement of the pressing plate 500 is restricted. When the pumping member 400 is inserted into the circular groove 510, the downward movement and lateral movement of the pressing plate 500 may be restricted.

Figure 10:
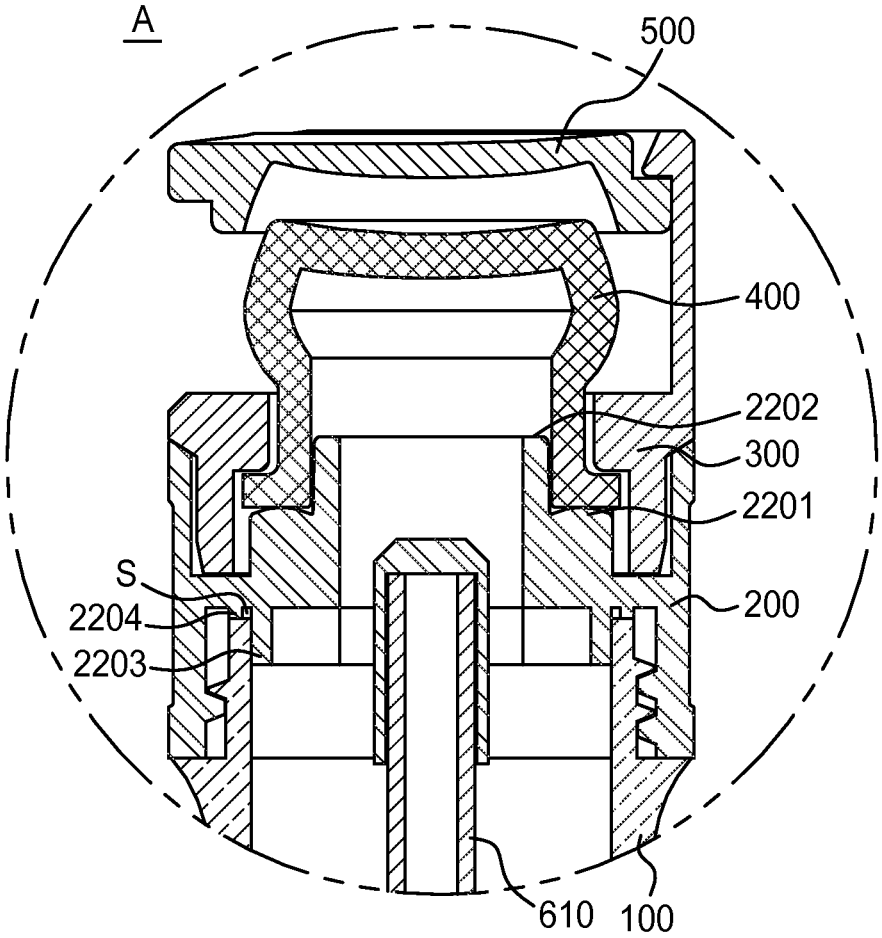
FIG. 10 is a diagram illustrating an enlarged area A in the cross-sectional view in FIG. 2.
Figure 11:
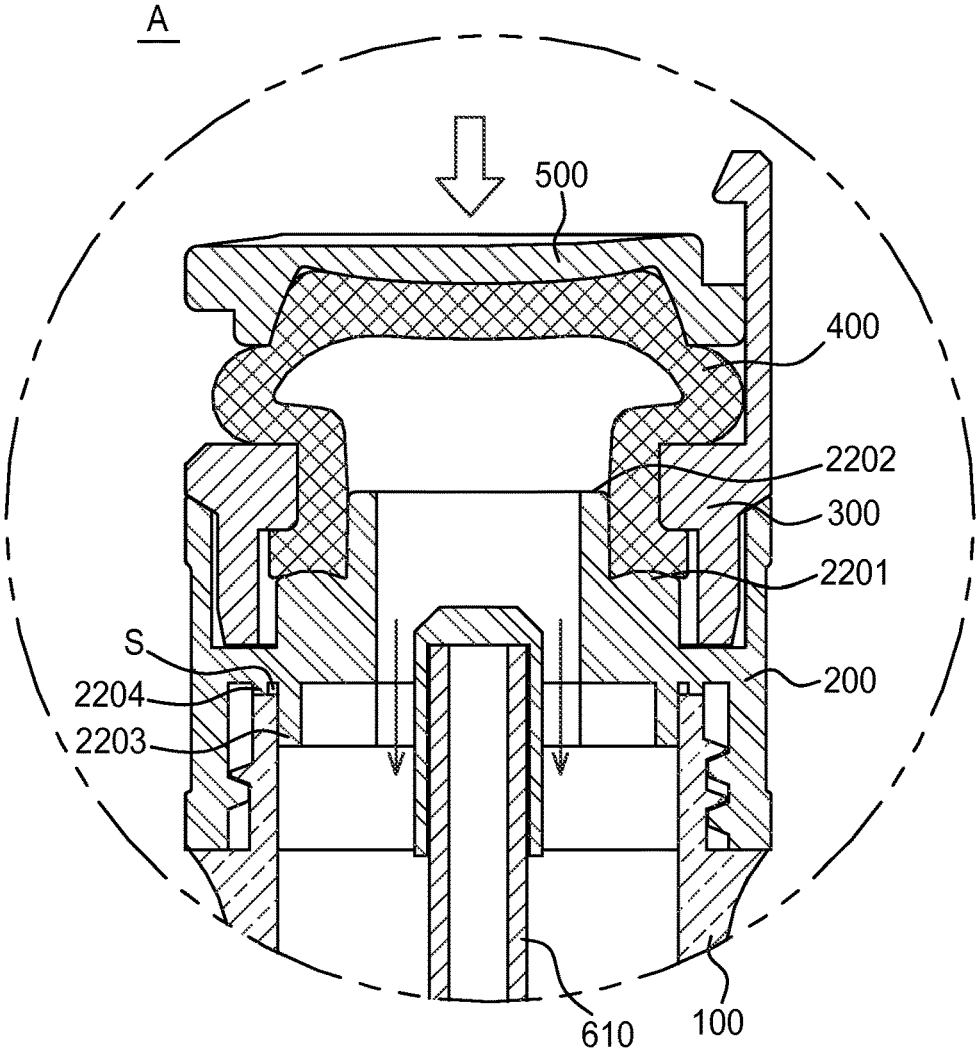
FIG. 11 is a diagram illustrating an enlarged area A in the cross-sectional view in FIG. 2 when the pipette device in FIG. 1 is operated.

FIG. 10 is a diagram illustrating an enlarged area A in the cross-sectional view in FIG. 2. FIG. 11 is a diagram illustrating a state of the area A when the pumping member 400 is pressed as in FIG. 4.

Referring to FIG. 10, it illustrates a state in which the container 100, the first fixing member 200, the pumping member 400 and the second fixing member 300 are coupled. The first fixing member 200 and the second fixing member 300 may be coupled by interposing the lower end portion of the pumping member 400 therebetween. The container 100 may be coupled to the first fixing member 200.

When the container 100 and the first fixing member 200 are coupled, the third support 2203 of the first fixing member 200 is inserted into the container 100 through the opened end portion of the container 100. In this case, the fourth support 2204 may come in contact with a surface of the end portion of the container 100. As described above, when the third support 2203 and the fourth support 2204 are disposed to be spaced from each other, a predetermined empty space (S) surrounded by the third support 2203, the fourth support 2204 and the end portion of the container 100 may be formed.

When the container 100 and the first fixing member 200 are coupled, the third support 2203 is inserted into the container 100 and accordingly a position of the container 100 may be fixed. Moreover, the third support 2203 serves as a primary barrier between the internal space of the container 100 and outside air, and the fourth support 2204 serves as a secondary barrier between the internal space of the container 100 and outside air. When the third support 2203 primarily blocks the internal space of the container 100 from outside air and the fourth support 2204 is provided as a secondary block, a phenomenon in which a liquid stored inside the container 100 evaporates, due to temperature and humidity differences between the internal space of the container 100 and outside air, may be minimized.

In addition, an air layer may be formed in the empty space (S) between the fourth support 2204 and the third support 2203. The air layer formed in the empty space (S) serves as an insulation layer, and therefore the phenomenon in which a liquid stored inside the container 100 evaporates may be prevented even more efficiently.

Referring to FIG. 11, when the pumping member 400 is pressed, a shape of the pumping member 400 may be changed and compressed. When the pumping member 400 is compressed, an internal space of the pumping member 400 decreases, and accordingly internal air of the pumping member 400 is discharged to the outside of the pumping member 400. As indicated by an arrow in FIG. 11, air discharged from the pumping member 400 may pass through the communication hole 230 of the first fixing member 200, and may be introduced into the container 100. In proportion to an amount of the introduced air, an interior pressure of the container 100 increases. Due to the increased pressure, the liquid inside the container 100 may be discharged to the outside through the nozzle 110.

Since the lower end portion of the pumping member 400 is firmly fixed between the first fixing device and the second fixing device, when the pumping member 400 is pressed, the lower end portion of the pumping member 400 is not pushed downwardly, and only the shape of the pumping member 400 may be changed. The pressing plate 500 mounted on the upper surface of the pumping member 400 may uniformly deliver a force with which the user presses to the upper surface of the pumping member 400.

In addition, as described above, when the first support 2201 is formed on a curved surface that is convex and faces upwardly, bending of the first support 2201 may prevent the lower end portion of the pumping member 400 from being pushed outwardly when the pumping member 400 is compressed. In addition, when the pumping member 400 is compressed, the lower end portion of the pumping member 400 may be changed to have a shape combined with the upper surface of the first support 2201. As a result, the lower end portion of the pumping member 400 may come in close contact with the upper surface of the first support 2201, and when the shape of the pumping member 400 is changed, internal air of the pumping member 400 may be prevented from leaking through a gap between the lower end portion of the pumping member 400 and the first support 2201.

As described above, when the pumping member 400 is pressed, the position of the pumping member 400 is fixed, and a force is uniformly delivered to the upper surface of the pumping member 400 by the pressing plate 500. When the pumping member 400 is compressed, internal air of the pumping member 400 is prevented from leaking downward at the lower end portion of the pumping member 400. Therefore, a volume of air delivered from the pumping member 400 into the container 100 when the pumping member 400 is pressed once may be constantly maintained. Therefore, a volume of a liquid discharged from the nozzle 110 of the container 100 when the pumping member 400 is pressed once may be constantly maintained every time.

The above effect may be understood when the following Table 1 and Table 2 are compared. As shown in Table 1, an amount of a discharged liquid is recorded using the pipette device 10 in the related art in which the user should adjust an amount of a liquid to be discharged, while viewing a scale displayed in the container 100. As shown in Table 2, an amount of a liquid discharged when the pumping member 400 is pressed in the pipette device 10 of the present embodiment is recorded. As shown in Table 1, a liquid by a scale corresponding to a volume of 1 mL is discharged once using the pipette device 10 in the related art. As shown in Table 2, the pipette device 10 used in the experiment was designed such that a liquid corresponding to a volume of 1 mL is discharged when the pumping member 400 is pressed once. As shown in each Table, columns represent each experiment and rows represent a first discharge, a second discharge and a third discharge in each experiment.

TABLE 1

| | First | Second | Third | Fourth | Fifth | Sixth | Seventh | Eighth | Ninth | Average | Standard deviation |
|---|---|---|---|---|---|---|---|---|---|---|---|
| First discharge | 0.956 | 1.12 | 0.95 | 1.03 | 1.09 | 1.15 | 0.96 | 1.04 | 1.14 | 1.05 | 0.08 |
| Second discharge | 1.01 | 0.96 | 1.12 | 1.01 | 1.06 | 1.06 | 0.95 | 1.05 | 1.06 | 1.03 | 0.05 |

TABLE 1-continued

| | First | Second | Third | Fourth | Fifth | Sixth | Seventh | Eighth | Ninth | Average | Standard deviation |
|---|---|---|---|---|---|---|---|---|---|---|---|
| Third discharge | 1.11 | 0.95 | 1.03 | 1.05 | 1.05 | 0.07 | 0.95 | 0.95 | 1.01 | 0.91 | 0.32 |
| Average | 1.03 | 1.01 | 1.03 | 1.03 | 1.07 | 0.76 | 0.95 | 1.01 | 1.07 | | |
| Standard deviation | 0.08 | 0.1 | 0.09 | 0.02 | 0.02 | 0.6 | 0.01 | 0.06 | 0.07 | | |

TABLE 2

| | First | Second | Third | Fourth | Fifth | Sixth | Seventh | Eighth | Ninth | Average | Standard deviation |
|---|---|---|---|---|---|---|---|---|---|---|---|
| First discharge | 0.98 | 0.99 | 1.01 | 0.99 | 1.01 | 0.99 | 1 | 1.01 | 1.01 | 1 | 0.01 |
| Second discharge | 1 | 1.03 | 1.02 | 1 | 1.02 | 1.01 | 0.99 | 1.04 | 1.01 | 1.01 | 0.02 |
| Third discharge | 0.97 | 1.08 | 1.03 | 1.02 | 1.04 | 0.99 | 1.01 | 1.02 | 1 | 1.02 | 0.03 |
| Average | 0.98 | 1.03 | 1.02 | 1 | 1.02 | 1 | 1 | 1.02 | 1.01 | | |
| Standard deviation | 0.02 | 0.05 | 0.01 | 0.02 | 0.02 | 0.01 | 0.01 | 0.02 | 0.01 | | |

When Table 1 and Table 2 are compared, it can be understood that a volume of a measured liquid in Table 2 is significantly close to 1 mL. In particular, as shown in Table 2, an average value of volumes of discharged liquids in each experiment and an average value of volumes of discharged liquids in first to third discharges of all experiments are significantly closer to 1 mL than those in Table 1. In addition, standard deviations calculated in Table 2 are significantly lower than those in Table 1. This means that, when the pipette device according to the present embodiment is used, errors in which a discharged liquid is not 1 mL every time are significantly decreased. That is, as shown in the experiment results, when the pipette device according to the present embodiment is used, it can be understood that an accurate amount of liquid may be uniformly discharged.

Meanwhile, when the first support 2201 is formed in a curved surface that is convex and faces upwardly and the pumping member 400 is compressed, if the lower end portion of the pumping member 400 is changed to have a shape combined with the upper surface of the first support 2201, a liquid leaked outside the container 100 may be blocked between the flange portion 410 and the first support 2201.

As a result, leakage of the liquid inside the container 100 may be prevented more efficiently.

Figure 12:
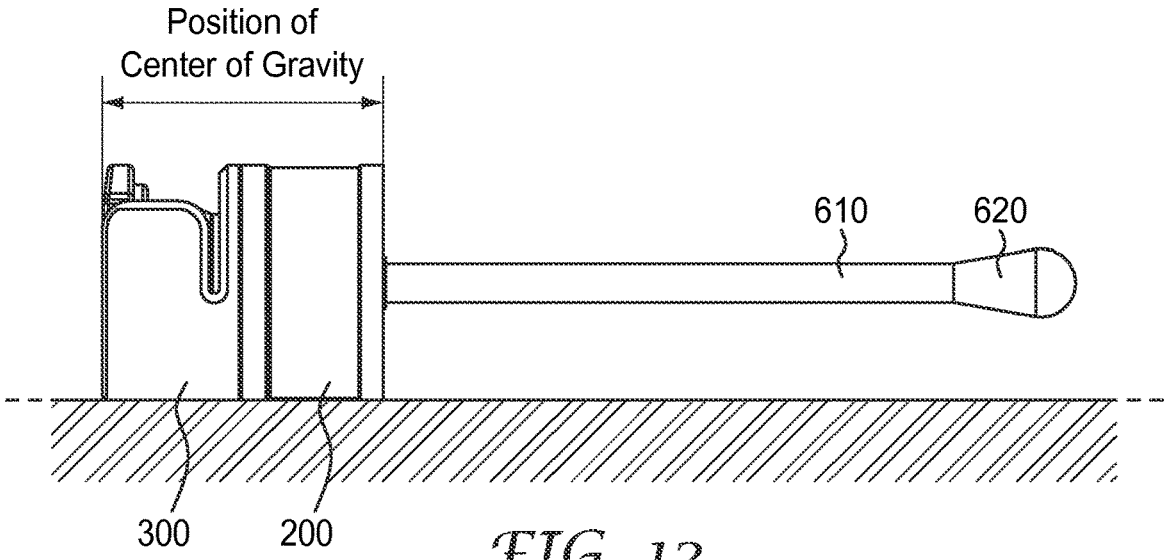
FIG. 12 is a diagram illustrating a state in which a stick member and a collecting tip included in the pipette device in FIG. 1 are maintained.

FIG. 12 is a diagram illustrating a state in which the stick member 610 and the collecting tip 620 included in the pipette device 10 in FIG. 1 are maintained.

Referring to FIG. 12, when the first fixing member 200 and the second fixing member 300 are coupled, the center of gravity of a structure in which the collecting tip 620, the stick member 610, the first fixing member 200 and the second fixing member 300 are coupled may be positioned on the first fixing member 200 or the second fixing member 300. In this case, since the center of gravity is positioned on the first fixing member 200 or the second fixing member 300, the collecting tip 620 may not come in contact with a floor surface when the collecting tip 620 is maintained as in FIG. 12. Since the collecting tip 620 may be maintained out of contact with the floor surface, it is possible to prevent the collecting tip 620 from being contaminated, and is also possible to improve reliability of sample collection.

Figure 13A:
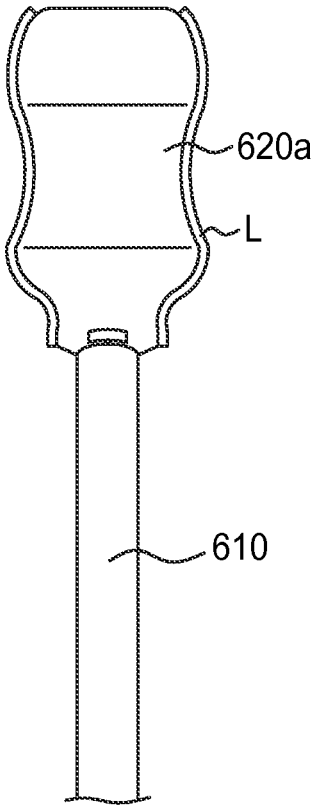
FIG. 13A is a diagram illustrating another embodiment of the collecting tip included in the pipette device of the present invention.
Figure 13B:
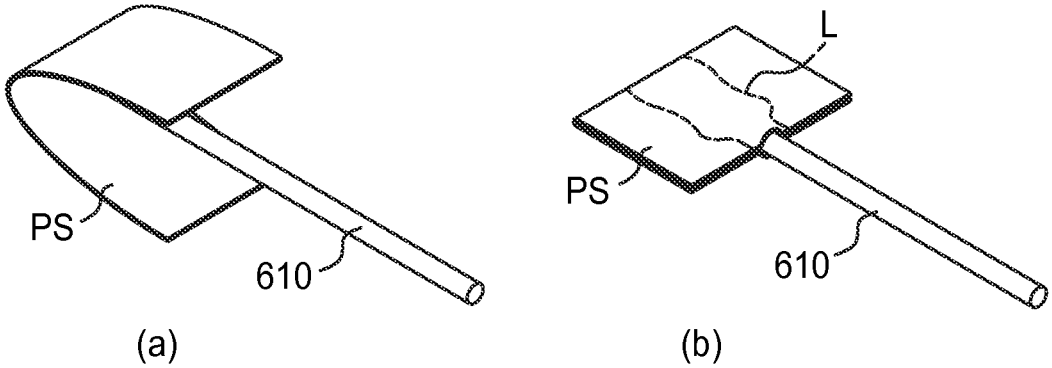
FIG. 13B is a diagram schematically illustrating a state in which the collecting tip in FIG. 13A is manufactured.

FIG. 13A is a diagram illustrating another embodiment of the collecting tip included in the pipette device 10 of the present invention. FIG. 13B is a diagram schematically illustrating a state in which a collecting tip 620*a* in FIG. 13A is manufactured.

According to the present embodiment, the collecting tip 620*a* may be made of a polyurethane foam having a predetermined pore size. Specifically, as illustrated in FIG. 13A, the collecting tip 620*a* may be made of a polyurethane foam sheet PS. In this case, the collecting tip 620*a* may be formed in a shape in which the polyurethane foam sheet PS is bent by interposing the stick member 610 therebetween, and then edges of the polyurethane foam sheet PS overlapping at both sides of the stick member 610 are bonded. The edge of the collecting tip 620*a* may be formed in a straight line or a curved line.

The pore size of the polyurethane foam sheet PS may be from 60 pores per inch (ppi) or more to 100 ppi or less. When the collecting tip 620*a* is made of the polyurethane foam sheet PS having the pore size of the value range, sample collecting performance may be improved. Specifically, since the polyurethane foam sheet PS having the pore size of said range is denser than common cotton, a phenomenon in which a sample attached to the collecting tip 620*a* is absorbed into the collecting tip 620*a* may be minimized. As a result, the sample attached to the collecting tip 620*a* may be separated from the collecting tip 620*a* more easily, and recovery efficiency of the sample may be improved.

Referring to (1) and (2) in FIG. 13B, in order to manufacture the collecting tip 620*a* according to the above-described embodiment, first, the polyurethane foam sheet PS having the preset pore size may be manufactured. The polyurethane foam sheet PS may be bent by interposing the stick member 610 therebetween. While the polyurethane foam sheet PS is folded in half, the polyurethane foam sheet PS that overlaps at both sides of the stick member 610 may be bonded along a line (L) of a predetermined shape. The polyurethane foam sheet PS may be bonded by heat treatment. After the doubled polyurethane foam sheet PS is bonded, the polyurethane foam sheet PS is cut and a shape of the collecting tip 620*a* may be formed. In addition, an end portion of the polyurethane foam sheet PS and the stick member 610 may be bonded. The polyurethane sheet (PS) and the stick member 610 may be bonded by heat treatment.

When the collecting tip 620*a* is manufactured, the overlapped polyurethane foam sheet PS is bonded at both sides of the stick member 610, and the end portion of the polyurethane foam sheet PS may be bonded to the stick member 610 at the same time. In addition, the line (L) at which the overlapped polyurethane foam sheet PS is bonded may be the same as a boundary shape of the collecting tip 620*a*.

In this case, the polyurethane foam sheet PS may be cut along the line (L) at which the PS is bonded and form a shape of the collecting tip 620*a*.

Embodiments of the present invention are listed below.

Item 1 is a pipette device, including: a container having a predetermined space therein, in one end of which a nozzle is formed and the other end of which is opened; a first fixing member whose one end is detachably coupled to the other end of the container; a second fixing member coupled to the other end of the first fixing member; and a pumping member that is inserted into the second fixing member such that an opened end portion faces the other end of the container, delivers internal air into the container by changing in shape when it is pressed, and presses an internal space of the container, wherein the opened end portion of the pumping member is fixed between the first fixing member and the second fixing member by coupling of the first fixing member and the second fixing member.

Item 2 is the pipette device of item 1, further including a cap that is connected to the one end of the container, and is able to open and close the nozzle.

Item 3 is the pipette device of items 1 and 2, wherein the cap includes an insertion protrusion that protrudes from an inside surface, and is able to be inserted into the nozzle when the cap is closed.

Item 4 is the pipette device of items 1 to 3, wherein the container further includes an extending portion that extends from an upper end of the nozzle into the container with a predetermined length.

Item 5 is the pipette device of items 1 to 4, wherein an inner circumferential surface of the extending portion includes a plurality of uneven portions representing a surface roughness of a preset value.

Item 6 is the pipette device of items 1 to 5, wherein the first fixing member includes: a cylindrical body; a partition wall that protrudes inward from an inner circumferential surface of the body and divides an inside of the body into an upper portion and a lower portion; and a communication hole that passes through the partition wall, and wherein the communication hole connects an internal space of the container and an inside of the pumping member.

Item 7 is the pipette device of items 1 to 6, wherein, in an upper surface of the partition wall, a first support that protrudes upwardly along a circumference of the communication hole and comes in contact with a lower end of the pumping member when an upper surface thereof is coupled to the first fixing member and the second fixing member, and a second support that protrudes upwardly from the upper surface of the first support along a circumference of the communication hole and is inserted into the pumping member when the first fixing member and the second fixing member are coupled, are formed, and wherein the second support has a smaller outer diameter than the first support.

Item 8 is the pipette device of items 1 to 7, wherein the upper surface of the first support is formed in a curved surface that is convex and faces upwardly.

Item 9 is the pipette device of items 1 to 8, wherein, in a lower surface of the partition wall, a circular third support that protrudes downwardly from the outside of the communication hole and is inserted into the container when the container and the first fixing member are coupled and a circular fourth support that protrudes downwardly from the outside of the third support and has a lower surface that comes in contact with an upper end of the container, are formed, and wherein the third support and the fourth support are spaced from each other.

Item 10 is the pipette device of items 1 to 9, wherein, in the first fixing member, a collecting tip is formed in an end portion, and a stick member that is accommodated inside the container when the first fixing member is coupled to the container is fixed.

Item 11 is the pipette device of items 1 to 10, wherein the first fixing member further includes: a stick fixing portion provided inside the communication hole; and a plurality of ribs that connect a circumferential surface of the communication hole and the stick fixing portion, and wherein the stick member is inserted into and fixed to the stick fixing portion.

Item 12 is the pipette device of items 1 to 11, wherein the collecting tip is made of a polyurethane.

Item 13 is the pipette device of items 1 to 12, wherein the collecting tip is made of a polyurethane foam sheet having a pore size of a predetermined value.

Item 14 is the pipette device of items 1 to 13, wherein the pore size of the preset value is from 60 pores per inch (ppi) or more to 100 ppi or less.

Item 15 is the pipette device of items 1 to 14, wherein, when the first fixing member and the second fixing member are coupled, the center of gravity of a structure in which the collecting tip, the stick member, the first fixing member and the second fixing member are coupled is positioned on the first fixing member or the second fixing member.

Item 16 is the pipette device of items 1 to 15, wherein the second fixing member includes: a cylindrical body whose side surface is partially recessed from an upper end; a through-hole that is formed by passing through the body and into which the pumping member is inserted; and a protrusion that protrudes inward from an upper end of an inner circumferential surface of the body.

Item 17 is the pipette device of items 1 to 16, further including a pressing plate that has a side surface from which a fitting protrusion protrudes and a lower surface having a circular groove formed thereon, wherein the pressing plate is inserted between the pumping member and the second fixing member when the fitting protrusion is positioned below the protrusion while an upper end of the pumping member is inserted into the circular groove.

Item 18 is the pipette device of items 1 to 17, wherein the first fixing member includes a plurality of first fastening grooves that extend in a longitudinal direction and are disposed to have constant interval therebetween and a second fastening groove that extends along a circumference of an inside surface to be perpendicular to the first fastening groove, wherein the second fixing member includes a plurality of first fastening protrusions that extend in a longitudinal direction and are disposed to have the constant interval therebetween and a second fastening protrusion that extends along a circumference of an outside surface to be perpendicular to the first fastening protrusion, and wherein the first fixing member and the second fixing member are coupled when each of the first fastening protrusions is inserted into each of the first fastening grooves and the second fastening protrusion is inserted into the second fastening groove, respectively.

Item 19 is the pipette device of items 1 to 18, wherein the pumping member is made of silicone or rubber.

Item 20 is the pipette device of items 1 to 19, wherein the pumping member includes: a pressing portion that has an empty space therein and an upper portion that is formed to be flat; a column portion that extends to a longitudinal direction from an end portion of the pressing portion with a predetermined length; and a flange portion that protrudes perpendicular to the column portion along a circumference of the column portion from an end portion of the column portion, and wherein the pressing portion has a greater thickness than the column portion.

Item 21 is the pipette device of items 1 to 20, further including a pressing plate that is inserted between the second fixing member and the pumping member and mounted on an upper surface of the pumping member.

While detailed embodiments of the pipette device and the manufacturing method according to the present invention have been described above, these are only examples, and the present invention is not limited thereto, but may be interpreted to have the widest scope according to the basic idea disclosed in this specification. Those skilled in the art may implement patterns of shapes that are not indicated by combining and replacing the disclosed embodiments within a range, not departing from the scope of the present invention. In addition, those skilled in the art may easily change and modify the disclosed embodiments based on this specification, and it will be apparent that such changes or modifications are within the scope of the present invention.

List of Reference Numerals

| | |
|---|---|
| 10: pipette device | 100: container |
| 110: nozzle | 112: extending portion |
| 114: uneven portion | 120: thread of container |
| 200: first fixing member | 210: body of first fixing member |
| 220: partition wall | 230: communication hole |
| 240: rib | 250: stick fixing portion |
| 260a: first fastening groove | 260b: second fastening groove |
| 290: thread of first fixing member | 2201: first support |
| 2202: second support | 2203: third support |
| 2204: fourth support | 300: second fixing member |
| 310: through-hole | 320: body of second fixing member |
| 330: protrusion | 360a: first fastening protrusion |
| 360b: second fastening protrusion | 400: pumping member |
| 410: flange portion | 420: column portion |
| 430: pressing portion | t1: thickness of pressing portion |
| t2: thickness of column portion | 500: pressing plate |
| 510: round hole | 520: body of pressing plate |
| 530: fitting protrusion | 610: stick member |
| 620, 620a: collecting tip | PS: polyurethane foam sheet |
| 700: cap | 710: insertion protrusion |

What is claimed is:

1. A pipette device, comprising:

a container having a predetermined space therein, the container comprising one end at which a nozzle is formed and another end that is opened;

a first fixing member whose one end is detachably coupled to the other end of the container;

a second fixing member coupled to the other end of the first fixing member; and a pumping member having an inner diameter, wherein the pumping member is inserted into the second fixing member such that an opened end portion faces the other end of the container, wherein when the pumping member is capable of being pressed to change its shape and deliver internal air into the container while pressurizing an internal space of the container, wherein the opened end portion of the pumping member is fixed between the first fixing member and the second fixing member by coupling the first fixing member to the second fixing member;

wherein the pumping member includes:

a pressing portion that has an empty space therein and an upper portion that is formed to be flat;

a column portion that extends to a longitudinal direction with a predetermined length from an end portion of the pressing portion; and a flange portion that is disposed between the first fixing member and second fixing member and that protrudes perpendicular to the column portion along a circumference of the column portion from an end portion of the column portion; and wherein the pressing portion has a thickness greater than that of the column portion; and wherein when the pressing portion is pressed a boundary between the pressing portion and the column portion is compressed to cause a clicking sensation indicating that the pressing operation is complete.

2. The pipette device according to claim 1, further comprising a collecting tip.

3. The pipette device according to claim 2, further comprising a stick member.

4. The pipette device according to claim 1, further comprising a cap that is connected to the one end of the container, and is able to open and close the nozzle.

5. The pipette device according to claim 4, wherein the cap includes an insertion protrusion that protrudes from an inside surface, and is able to be inserted into the nozzle when the cap is closed.

6. The pipette device according to claim 1, wherein the container further includes an extending portion that extends a predetermined length from an upper end of the nozzle into the container.

7. The pipette device according to claim 6, wherein an inner circumferential surface of the extending portion includes a plurality of uneven portions representing a surface roughness of a preset value.

8. The pipette device according to claim 1, wherein the first fixing member includes:

a cylindrical body;

a partition wall that protrudes inward from an inner circumferential surface of the cylindrical body and divides an inside of the body into an upper portion and a lower portion; and a communication hole that passes through the partition wall, and wherein the communication hole connects an internal space of the container with an inside of the pumping member.

9. The pipette device according to claim 8, wherein, in an upper surface of the partition wall, the first support protrudes upwardly along a circumference of the communication hole and comes in contact with a lower end of the pumping member when an upper surface thereof is coupled to the first fixing member and the second fixing member, and a second support that protrudes upwardly from the upper surface of the first support along a circumference of the communication hole and is inserted into the pumping member when the first fixing member and the second fixing member are coupled, are formed, and wherein the second support has an outer diameter smaller than that of the first support.

10. The pipette device according to claim 9, wherein the upper surface of the first support is formed in a curved surface that is convex and faces upwardly.

11. The pipette device according to claim 8, wherein, in a lower surface of the partition wall, a circular third support that protrudes downwardly from outside of the communication hole and is inserted into the container when the container and the first fixing member are coupled, and a circular fourth support that protrudes downwardly from outside of the third support and has a lower surface that comes in contact with an upper end of the container, are formed, and wherein the third support and the fourth support are spaced from each other.

12. The pipette device according to claim 1, wherein the first fixing member further includes:

a stick fixing portion provided inside the communication hole; and a plurality of ribs that connect a circumferential surface of the communication hole and the stick fixing portion, and wherein the stick member is inserted into and fixed to the stick fixing portion.

13. The pipette device according to claim 2, wherein the collecting tip is made of a polyurethane.

14. The pipette device according to claim 13, wherein the collecting tip is made of a polyurethane foam sheet having a pore size of a predetermined value.

15. The pipette device according to claim 14, wherein the pore size of the predetermined value is from 60 pores per inch (ppi) or more to 100 ppi or less.

16. The pipette device according to claim 3, wherein, when the first fixing member and the second fixing member are coupled, the center of gravity of a structure in which the collecting tip, the stick member, the first fixing member and the second fixing member are coupled is positioned on the first fixing member or the second fixing member.

17. The pipette device according to claim 1, wherein the second fixing member includes:

a cylindrical body whose side surface is partially recessed from an upper end;

a through-hole that is formed by passing through the body and into which the pumping member is inserted; and a protrusion that protrudes inward from an upper end of an inner circumferential surface of the body.

18. The pipette device according to claim 17, further comprising a pressing plate that has a side surface from which a fitting protrusion protrudes and a lower surface having a circular groove formed thereon, wherein the pressing plate is inserted between the pumping member and the second fixing member when the fitting protrusion is positioned below the protrusion while an upper end of the pumping member is inserted into the circular groove.

19. The pipette device according to claim 1, wherein the first fixing member includes a plurality of first fastening grooves that extend to a longitudinal direction, and are disposed to have constant interval therebetween and a second fastening groove that extends along a circumference of an inside surface to be perpendicular to the first fastening groove, wherein the second fixing member includes a plurality of first fastening protrusions that extend to a longitudinal direction, and are disposed to have the constant interval therebetween and a second fastening protrusion that extends along a circumference of an outside surface to be perpendicular to the first fastening protrusion, and wherein the first fixing member and the second fixing member are coupled when each of the first fastening protrusions is inserted into each of the first fastening grooves and the second fastening protrusion is inserted into the second fastening groove, respectively.

20. The pipette device according to claim 1, further comprising a pressing plate that is inserted between the second fixing member and the pumping member, and is mounted on an upper surface of the pumping member.

* * * * *